US011551607B1

(12) United States Patent
Hashimoto et al.

(10) Patent No.: US 11,551,607 B1
(45) Date of Patent: Jan. 10, 2023

(54) ELECTRONIC DEVICE

(71) Applicant: Innolux Corporation, Miao-Li County (TW)

(72) Inventors: Kazuyuki Hashimoto, Miao-Li County (TW); Hidetoshi Watanabe, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/745,884

(22) Filed: May 17, 2022

Related U.S. Application Data

(60) Provisional application No. 63/234,716, filed on Aug. 19, 2021.

(51) Int. Cl.
*G09G 3/32* (2016.01)
*G09G 3/00* (2006.01)

(52) U.S. Cl.
CPC ..... *G09G 3/32* (2013.01); *G09G 3/006* (2013.01); *G09G 2300/0814* (2013.01); *G09G 2300/0876* (2013.01); *G09G 2330/12* (2013.01)

(58) Field of Classification Search
CPC .. G09G 3/006; G09G 3/32; G09G 2300/0814; G09G 2300/0876
See application file for complete search history.

(56) References Cited

U.S. PATENT DOCUMENTS 5,122,784 A * 6/1992 Canova ..... G09G 5/02 345/636
7,405,711 B2 * 7/2008 Ikeda ..... G09G 3/22 345/87
7,843,412 B2 * 11/2010 So ..... G09G 3/3648 345/87
8,400,380 B2 * 3/2013 Lee ..... G09G 3/3233 345/83

* cited by examiner

*Primary Examiner* — Gene W Lee
(74) *Attorney, Agent, or Firm* — JCIPRNET

(57) ABSTRACT

An electronic device is provided. The electronic device includes a semiconductor element and a pixel circuit. The pixel circuit includes a first comparator, a second comparator and a subtraction unit. The first comparator generates a first comparison signal. The second comparator generates a second comparison signal. The subtraction unit is coupled to the semiconductor element and configured to receives the first comparison signal and the second comparison signal and generates a subtraction signal.

20 Claims, 14 Drawing Sheets

ELECTRONIC DEVICE

CROSS-REFERENCE TO RELATED APPLICATION

This application claims the priority benefit of U.S. Provisional application Ser. No. 63/234,716, filed on Aug. 19, 2021. The entirety of the above-mentioned patent application is hereby incorporated by reference herein and made a part of this specification.

BACKGROUND

Technical Field

The disclosure generally relates to an electronic device, and more particularly to an electronic device including a pixel circuit reducing voltage error from a transistor.

Description of Related Art

Generally, an electronic device including a pixel circuit needs a reset transistor to reset a voltage value on the pixel circuit. However, a parasitic capacitance of a reset transistor causes a voltage error. The voltage error induces emission time error of pulse-width modulation (PWM). How to reduce voltage error from a transistor of a pixel circuit in electronic device is one of the research and development focuses of those skilled in the art.

SUMMARY

The disclosure is related to an electronic device including a pixel circuit reducing voltage error from a transistor.

The disclosure provides an electronic device. The electronic device includes a semiconductor element and a pixel circuit. The pixel circuit includes a first comparator, a second comparator and a subtraction unit. The first comparator generates a first comparison signal. The second comparator generates a second comparison signal. The subtraction unit is coupled to the semiconductor element and configured to receives the first comparison signal and the second comparison signal and generates a subtraction signal.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
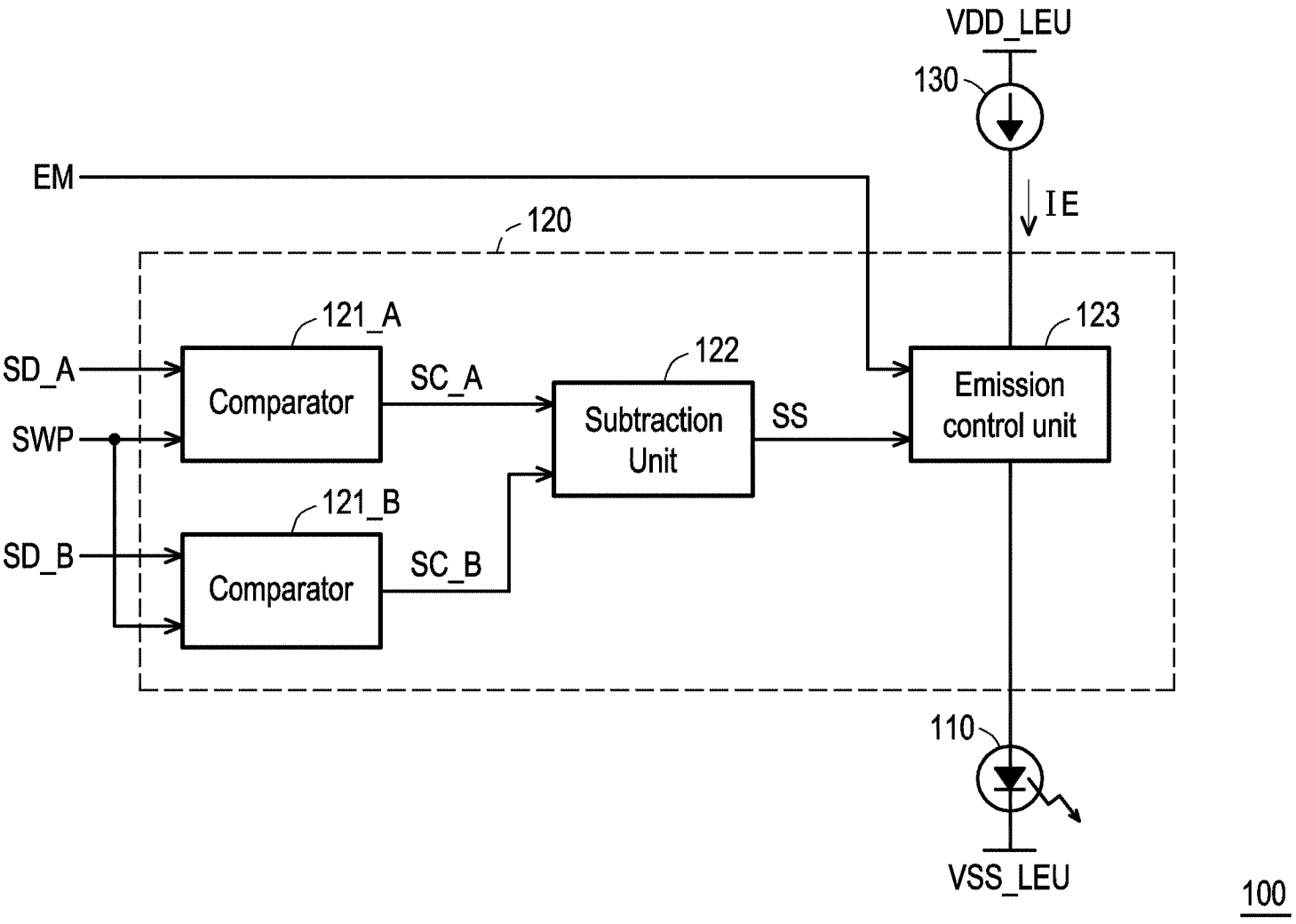
FIG. 1 illustrates a schematic diagram of an electronic device according to a first embodiment of the disclosure.

A disclosure may be understood by reference to the following detailed description, taken in conjunction with the drawings as described below. It is noted that, for purposes of illustrative clarity and being easily understood by the readers, various drawings of this disclosure show a portion of an electronic device, and certain elements in various drawings may not be drawn to scale. In addition, the number and dimension of each device shown in drawings are only illustrative and are not intended to limit the scope of a disclosure.

Certain terms are used throughout the description and following claims to refer to particular components. As one skilled in the art will understand, electronic equipment manufacturers may refer to a component by different names. This document does not intend to distinguish between components that differ in name but not function. In the following description and in the claims, the terms "include", "comprise" and "have" are used in an open-ended fashion, and thus should be interpreted to mean "include, but not limited to . . . ". Thus, when the terms "include", "comprise" and/or "have" are used in the description of a disclosure, the corresponding features, areas, steps, operations and/or components would be pointed to existence, but not limited to the existence of one or a plurality of the corresponding features, areas, steps, operations and/or components.

It will be understood that when an element is referred to as being "coupled to", "connected to", or "conducted to" another element, it may be directly connected to the other element and established directly electrical connection, or intervening elements may be presented therebetween for relaying electrical connection (indirectly electrical connection). In contrast, when an element is referred to as being "directly coupled to", "directly conducted to", or "directly connected to" another element, there are no intervening elements presented.

Although terms such as first, second, third, etc., may be used to describe diverse constituent elements, such constituent elements are not limited by the terms. The terms are used only to discriminate a constituent element from other constituent elements in the specification. The claims may not use the same terms, but instead may use the terms first, second, third, etc. with respect to the order in which an element is claimed. Accordingly, in the following description, a first constituent element may be a second constituent element in a claim.

In a disclosure, the embodiments use "pixel" or "pixel unit" as a unit for describing a specific region including at least one functional circuit for at least one specific function.

Describing "pixel with circuit" as "circuit" is available for a disclosure. For example, a "pixel with current source" may be described as a "current source", or a "pixel with current sink" may be described as a "current sink". The region of a "pixel" is depended on a unit for providing a specific function, adjacent pixels may share the same parts or wires, but may also include its own specific parts therein. For example, adjacent pixels may share a same scan line or a same data line, but the pixels may also have their own transistors or capacitance.

In a disclosure, a current source circuit is a circuit unit for outputting current, and a current sink is a circuit unit for draining current. The adjacent circuit units may share the same parts or wires and may also include its specific parts therein.

It should be noted that the technical features in different embodiments described in the following can be replaced, recombined, or mixed with one another to constitute another embodiment without departing from the spirit of a disclosure.

FIG. 1 illustrates a schematic diagram of an electronic device according to a first embodiment of the disclosure. Referring to FIG. 1, in the embodiment, an electronic device 100 includes a semiconductor element 110 and a pixel circuit 120. The pixel circuit 120 includes comparators 121_A, 121_B and a subtraction unit 122. The comparator 121_A generates a first comparison signal SC_A. The comparator 121_B generates a second comparison signal SC_B. The subtraction unit 122 is coupled to the comparator 121_A, the comparator 121_B and the semiconductor element 110. The subtraction unit 122 receives the first comparison signal SC_A and the second comparison signal SC_B. The subtraction unit 122 generates a subtraction signal SS according to the first comparison signal SC_A and the second comparison signal SC_B. The pixel circuit 120 provides the subtraction signal SS to control the semiconductor element 110. In the embodiment, the semiconductor element 110 comprises at least one light-output element. For example, the semiconductor element 110 comprises at least one LED, but the disclosure is not limited thereto. The semiconductor element 110 emits an emitting light based on the subtraction signal SS. The semiconductor element 110 may be organic light emitting diode (OLED), minimeter-sized light emitting diode (mini-LED), micrometer-sized light emitting diode (micro-LED), quantum dot light emitting diode (QLED), but not be limited thereto.

The subtraction unit 122 performs a subtraction operation on the first comparison signal SC_A and the second comparison signal SC_B to generate the subtraction signal SS. For example, the subtraction signal SS is a difference between a timing of the first comparison signal SC_A and a timing of the second comparison signal SC_B.

Generally, a parasitic capacitance of a reset transistor in the comparator 121_A causes a voltage error in the comparator 121_A, so that the timing of the first comparison signal SC_A is shifted. A parasitic capacitance of a reset transistor in the comparator 121_B causes a voltage error in the comparator 121_B, so that the timing of the second comparison signal SC_B is shifted. It should be noted, the subtraction unit 122 generates the subtraction signal SS according to the first comparison signal SC_A and the second comparison signal SC_B. The voltage errors from the comparator 121_A and the comparator 121_B may be eliminated. Therefore, the voltage error from a transistor in the electronic device 100 may be reduced.

In the embodiment, the electronic device 100 further includes a current source 130 for providing an emission current IE. The pixel circuit 110 further includes an emission control unit 123. The emission control unit 123 is coupled to the subtraction unit 122 and the semiconductor element 110. The emission control unit 123 transmits the emission current IE to the semiconductor element 110 in response to the subtraction signal SS and an emission enable signal EM. In the embodiment, the current source 130 is coupled between a power VDD_LEU and the emission control unit 123. The current source 130 may providing the emission current IE by the power VDD_LEU. The semiconductor element 110 is coupled between a voltage VSS_LEU and the emission control unit 123. The power VSS_LEU may be a ground voltage.

In the embodiment, the subtraction unit 122 may be implemented by a logic circuit or a subtraction circuit. The emission control unit 123 may be implemented by a scan circuit or a switching circuit controlled by the emission enable signal EM.

Figure 2:
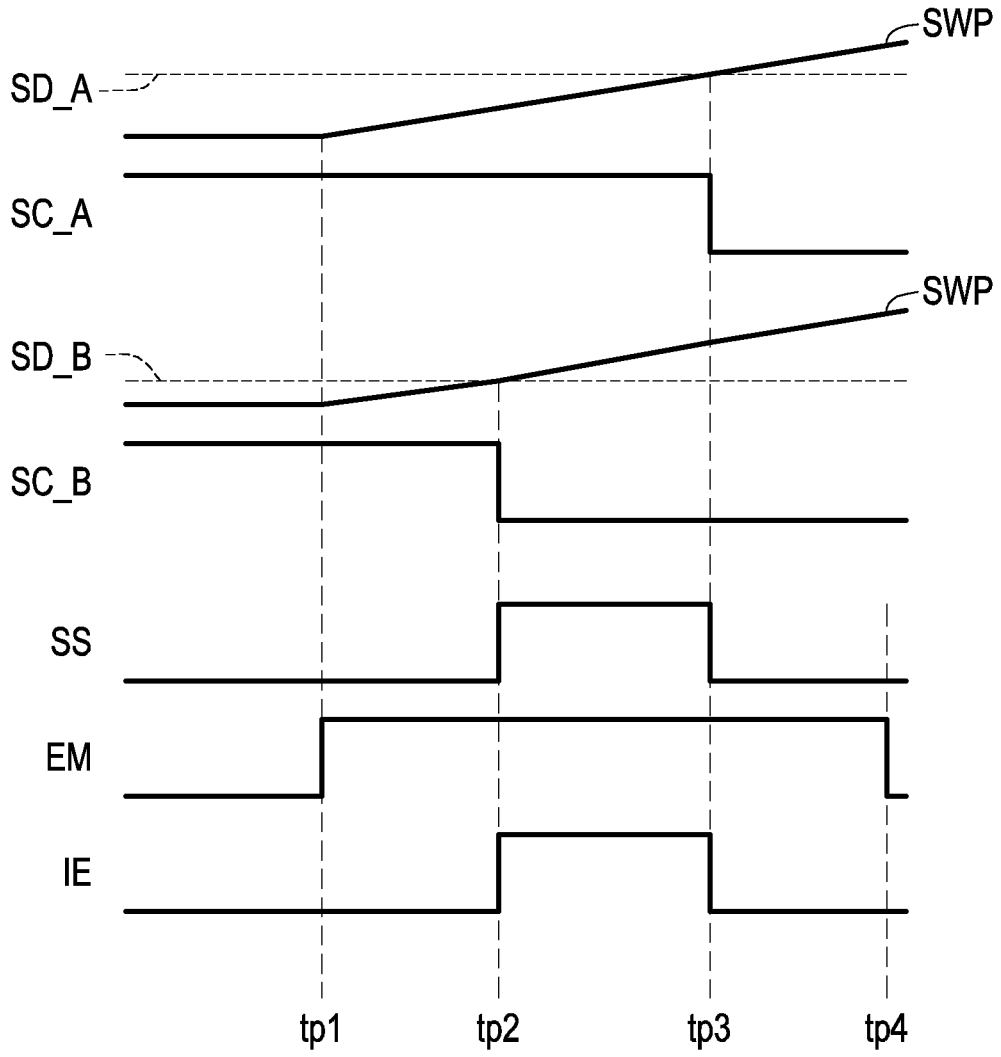
FIG. 2 illustrates an operating timing diagram of an electronic device.

Referring to FIG. 1 and FIG. 2, FIG. 2 illustrates an operating timing diagram of an electronic device. In the embodiment, the comparator 121_A receives a first data signal SD_A and a sweeping signal SWP. The comparator 121_A generates the first comparison signal SC_A according to the first data signal SD_A and the sweeping signal SWP. In the embodiment, a transition time point (for example, a time point of the falling edge) of the first comparison signal SC_A is determined based on the voltage value of the first data signal SD_A. For example, a voltage value of the sweeping signal SWP is swept-up at a time point tp1. When the voltage value of the sweeping signal SWP is lower than a voltage value of the first data signal SD_A, the comparator 121_A generates the first comparison signal SC_A having a high voltage value. When the voltage value of the sweeping signal SWP is high than or equal to the voltage value of the first data signal SD_A, the comparator 121_A generates the first comparison signal SC_A having a low voltage value. Therefore, the first comparison signal SC_A is transited from the high voltage value to the low voltage value at a time point tp3.

The comparator 121_B receives a second data signal SD_B and a sweeping signal SWP. The comparator 121_B generates the second comparison signal SC_B according to the second data signal SD_B and the sweeping signal SWP. In the embodiment, a transition time point (for example, a time point of the falling edge) of the second comparison signal SC_B is determined based on the voltage value of the second data signal SD_B. For example, a voltage value of the sweeping signal SWP is swept-up at the time point tp1. When the voltage value of the sweeping signal SWP is lower than a voltage value of the second data signal SD_B, the comparator 121_B generates the second comparison signal SC_B having a high voltage value. When the voltage value of the sweeping signal SWP is high than or equal to the voltage value of the first data signal SD_B, the comparator 121_B generates the second comparison signal SC_B having a low voltage value. Therefore, the second comparison signal SC_B is transited from the high voltage value to the low voltage value at a time point tp2.

The subtraction unit 122 generates the subtraction signal SS according to the difference between a timing of the first comparison signal SC_A and a timing of the second comparison signal SC_B. Therefore, the subtraction signal SS has the high voltage value between the time point tp2 and the time point tp3. In other words, the subtraction signal SS is a PWM signal determined by the first comparison signal SC_A and the second comparison signal SC_B.

In the embodiment, the emission enable signal EM is transited from the low voltage value to the high voltage value at the time point tp1. The emission enable signal EM is transited from the high voltage value to the low voltage value at a time point tp4. The emission enable signal EM having the high voltage value is provided from the time point tp1 to the time point tp4. Therefore, the emission control unit 123 provides the emission current IE to the semiconductor element 110 in response to the subtraction signal SS between the time point tp1 and point tp4.

In this embodiment, the emission control unit 123 is enabled in response to a high voltage level of the emission enable signal EM. In some embodiment, the emission control unit 123 is enabled in response to a low voltage level of the emission enable signal EM.

Figure 3:
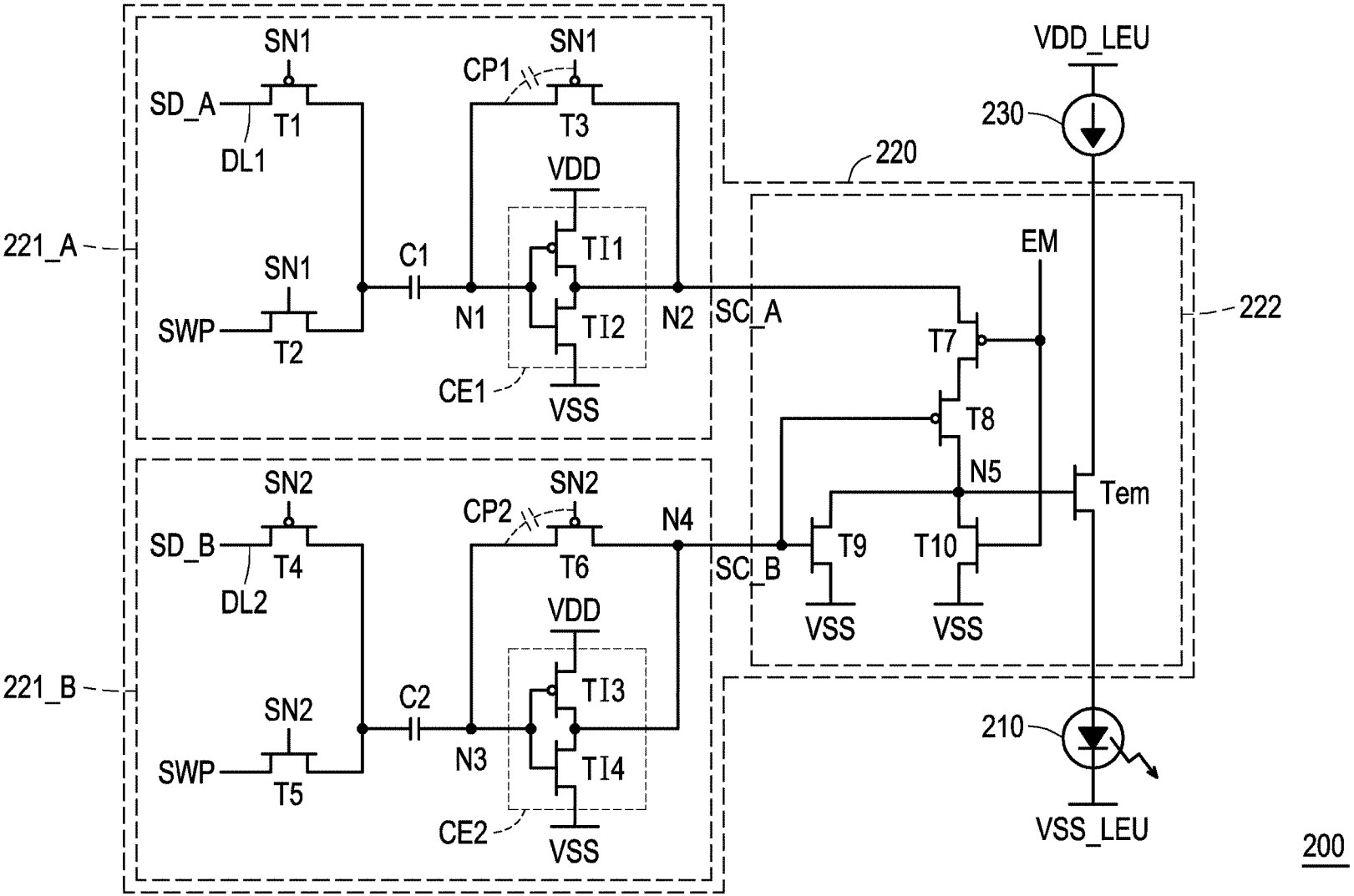
FIG. 3 illustrates a schematic diagram of an electronic device according to a second embodiment of the disclosure.
Figure 4:
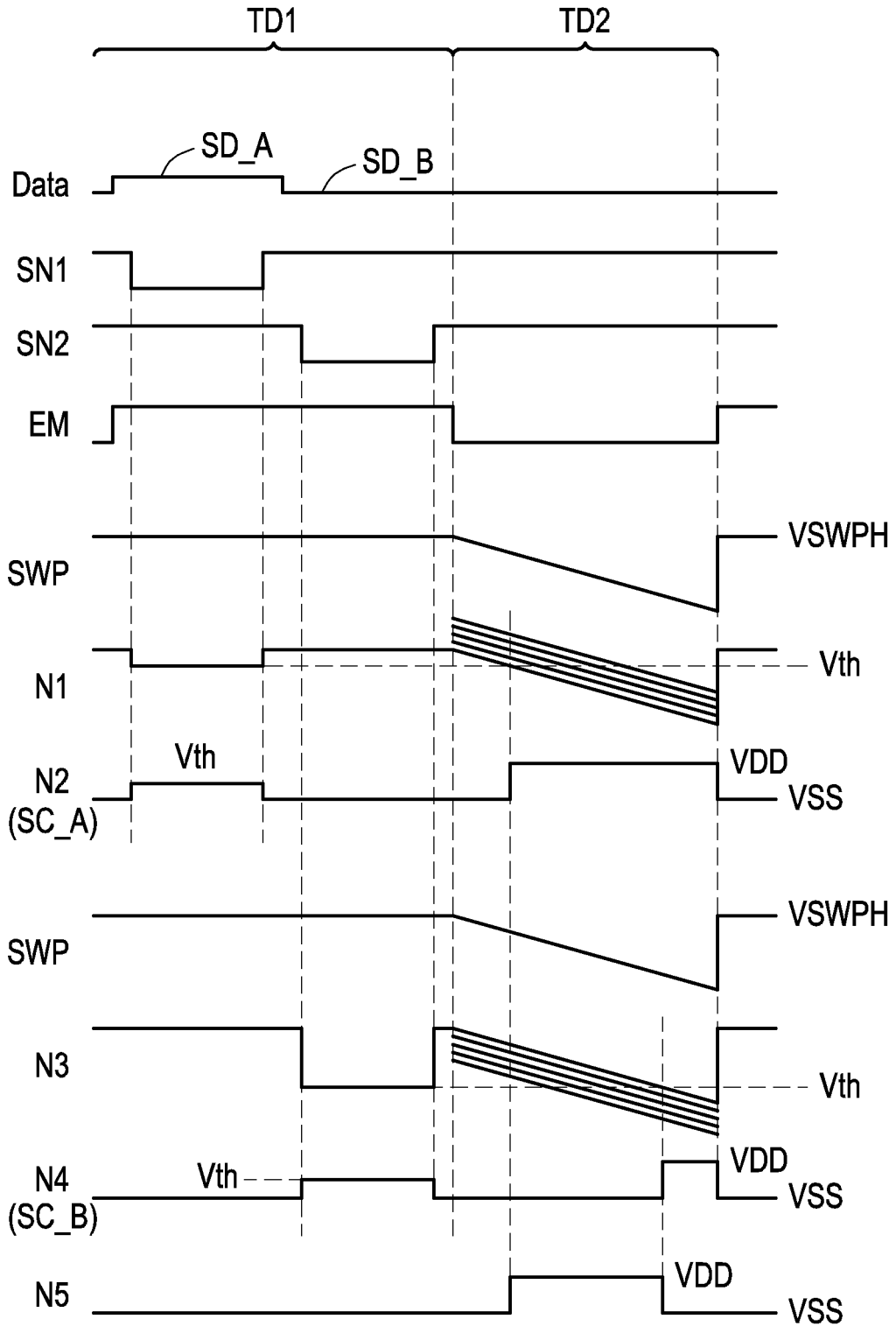
FIG. 4 illustrates an operating timing diagram of FIG. 3.

FIG. 3 illustrates a schematic diagram of an electronic device according to a second embodiment of the disclosure. FIG. 4 illustrates an operating timing diagram of FIG. 3. Referring to FIG. 3 and FIG. 4, in the embodiment, an electronic device 200 includes a semiconductor element 210, a pixel circuit 220 and a current source 230. The pixel circuit 220 includes comparators 221_A, 221_B and a subtraction unit 222. The comparator 221_A includes thin-film transistors (TFTs) T1, T2, T3, a capacitor C1 and a comparison element CE1. A first terminal of the TFT T1 is coupled to a data line DL and receives the first data signal SD_A via the data line DLL. A control terminal of the TFT T1 receives a first control signal SN1. A first terminal of the TFT T2 receives the sweeping signal SWP. A control terminal of the TFT T2 receives the first control signal SN1. A first terminal of the capacitor C1 is coupled to a second terminal of the TFT T1 and a second terminal of the TFT T2. A first terminal (that is, a node N1) of the comparison element CE1 is coupled to a second terminal of the capacitor C1, and a second terminal (that is, a node N2) of the comparison element CE1 is coupled to the subtraction unit 222. A first terminal of the TFT T3 is coupled to the first terminal of the comparison element CEL. A second terminal of the TFT T3 is coupled to the second terminal of the comparison element CE1. A control terminal of the TFT T3 receives the first control signal SN1. In the embodiment, the TFTs T1 and T3 are first type of TFTs respectively. The TFT T2 is a second type of TFT. For example, the TFT T1 and the TFT T3 may be PMOS respectively and the TFT T2 may be NMOS. In others embodiments, the TFT T1 and the TFT T3 may be NMOS respectively and the TFT T2 may be PMOS.

In the embodiment, the comparison element CE1 is an inverter. The comparison element CE1 includes TFTs TI1 and TI2. A first terminal of the TFT TI1 is coupled to a high reference voltage VDD. A second terminal of the TFT TI1 is coupled to the node N2. A control terminal of the TFT TI1 is coupled to the node N1. A first terminal of the TFT TI2 is coupled to the node N2. A second terminal of the TFT TI2 is coupled to a low reference voltage VSS. A control terminal of the TFT TI2 is coupled to the node N1.

The comparator 221_B includes TFTs T4, T5, T6, a capacitor C2 and a comparison element CE2. A first terminal of the TFT T4 is coupled to the data line DL2 and receives the second data signal SD_B via the data line DL2. A control terminal of the TFT T4 receives a second control signal SN2. A first terminal of the TFT T5 receives the sweeping signal SWP. A control terminal of the TFT T5 receives the second control signal SN2. A first terminal of the capacitor C2 is coupled to a second terminal of the TFT T4 and a second terminal of the TFT T5. A first terminal (that is, a node N3) of the comparison element CE2 is coupled to a second terminal of the capacitor C2, and a second terminal (that is, a node N4) of the comparison element CE2 is coupled to the subtraction unit 222. A first terminal of the TFT T6 is coupled to the first terminal of the comparison element CE2. A second terminal of the TFT T6 is coupled to the second terminal of the comparison element CE2. A control terminal of the TFT T6 receives the second control signal SN2. In the embodiment, the TFTs T4 and T6 are the first type of TFTs respectively. The TFT T5 is the second type of TFT. For example, the TFT T4 and the TFT T6 are PMOS respectively and the TFT T5 is NMOS. In others embodiments, the TFT T4 and the TFT T5 may be NMOS respectively and the TFT T6 may be PMOS.

In the embodiment, the comparison element CE2 is an inverter. The comparison element CE2 includes TFT TI3 and TFT TI4. A first terminal of the TFT TI3 is coupled to a high reference voltage VDD. A second terminal of the TFT TI3 is coupled to the node N4. A control terminal of the TFT TI3 is coupled to the node N3. A first terminal of the TFT TI4 is coupled to the node N4. A second terminal of the TFT TI4 is coupled to a low reference voltage VSS. A control terminal of the TFT TI4 is coupled to the node N3.

In the embodiment, the subtraction unit 222 includes TFTs T7, T8, T9, T10 and an enable TFT Tem. A first terminal of the TFT T7 receives the first comparison signal SC_A. A control terminal of the TFT T7 receives the emission enable signal EM. A first terminal of the TFT T8 is coupled to a second terminal of the TFT T7. A control terminal of the TFT T8 receives the second comparison signal SC_B. A first terminal of the TFT T9 is coupled to a second terminal of the TFT T8. A second terminal of the TFT T9 is coupled to the low reference voltage VSS. A control terminal of the TFT T9 receives the second comparison signal SC_B. A first terminal of the TFT T10 is coupled to the second terminal of the TFT T8. A second terminal of the TFT T10 is coupled to the low reference voltage VSS. A control terminal of the TFT T10 receives the emission enable signal EM. A first terminal of the enable TFT Tem receives an emission current IE. A second terminal of the enable TFT Tem is coupled to the semiconductor element 210. A control terminal of the enable TFT Tem and the second terminal of the TFT T8 are coupled to the node N5. A control terminal of the enable TFT Tem and the first terminal of the TFT T9 are coupled to the node N5. A control terminal of the enable TFT Tem receives the subtraction signal SS.

In the embodiment, the TFT T7 and the TFT T8 are the first type of TFTs respectively. The TFT T9, the TFT T10 and the enable TFT Tem are the second type of TFTs respectively. For example, the TFTs T7 and T8 are PMOS respectively. The TFTs T9, T10 and the enable TFT Tem are NMOS.

In the embodiment, the subtraction unit 222 is a combined circuit of the subtraction unit 122 and the emission control unit 123 as shown in FIG. 1.

Referring to FIG. 3 and FIG. 4, in the embodiment, in a reset time interval TD1, a voltage value of the emission enable signal EM is high. The comparator 221_A resets a voltage value of the first comparison signal SC_A on the second terminal of the comparison element CE1 to a threshold value Vth when the first control signal SN1 has a first voltage value (e.g. low voltage value). When the first control signal SN1 has the first voltage value, the TFTs T1 and T3 are turned-on and the TFT T2 is turned-off. Therefore, voltage values on the nodes N1 and N2 are reset to the threshold value Vth. For example, the threshold value Vth may be a threshold value of the TFT TI1 and the TFT TI2. In the embodiment, the TFT T3 is a reset transistor of the comparator 221_A.

In other hands, in the reset time interval TD1, when the first control signal SN1 has a second voltage value (e.g. high voltage value), the comparator 221_A raises a voltage value on the first terminal (that is, the node N1) of the comparison element CE1 from the threshold value Vth according to the first data signal SD_A and the sweeping signal SWP, and pulls-down the voltage value of the first comparison signal SC_A on the node N2 to a low voltage value. When the first control signal SN1 has the second voltage value, the TFTs T2 are turned-on and the TFTs T1 and T3 are turned-off. Based on the capacitor C1, the voltage value on the node N1 is pumped in response to a difference between a maximum voltage value VSWPH of the sweeping signal SWP and a voltage value of the first data signal SD_A. The comparison element CE1 inverts the voltage value on the node N1 to provide the first comparison signal SC_A on the node N2 having the low reference voltage.

In the reset time interval TD1, the comparator 221_B resets a voltage value of the second comparison signal SC_B on the second terminal of the comparison element CE2 to the threshold value Vth when the second control signal SN2 has the first voltage value. When the second control signal SN2 has the first voltage value, the TFTs T4 and T6 are turned-on and the TFT T5 is turned-off. Therefore, voltage values on the nodes N3 and N4 are reset to the threshold value Vth. In the embodiment, the TFT T6 is a reset transistor of the comparator 221_B.

In other hands, in the reset time interval TD1, when the second control signal SN2 has the second voltage value, the comparator 221_B raises a voltage value on the first terminal (that is, the node N3) of the comparison element CE2 from the threshold value Vth according to the second data signal SD_B and the sweeping signal SWP, and pulls-down the voltage value of the second comparison signal SC_B on the node N4 to the low voltage value. When the second control signal SN2 has the second voltage value, the TFTs T5 are turned-on and the TFTs T4 and T6 are turned-off. Based on the capacitor C2, the voltage value on the node N3 is pumped in response to a difference between a maximum voltage value VSWPH of the sweeping signal SWP and a voltage value of the second data signal SD_B. The comparison element CE2 inverts the voltage value on the node N3 to provide the second comparison signal SC_B on the node N4 having the low reference voltage. In the embodiment, the voltage value of the second data signal SD_B is lower than the voltage value of the first data signal SD_A.

Regarding to the subtraction signal SS on the node N5, the TFT T10 pulls down a voltage value of the subtraction signal SS to the low reference voltage VSS based on the emission enable signal EM having the high voltage value.

In the embodiment, in an emission time interval TD2, the voltage value of the emission enable signal EM is low. When the first control signal SN1 has the second voltage value and the voltage value on the first terminal of the first comparison element CE1 is pulled-down to be lower than the threshold value Vth, the comparator 221A raises the voltage value of the first comparison signal SC_A to the high voltage value. When the voltage value on the node N1 is pulled-down to be lower than the threshold value Vth, the comparison element CE1 inverts the voltage value on the node N1 to provide the first comparison signal SC_A on the node N2 having the high reference voltage VDD. When the second control signal SN2 has the second voltage value and the voltage value on the first terminal of the second comparison element CE2 is pulled-down to be lower than the threshold value Vth, the comparator 221_B raises the voltage value of the second comparison signal SC_B to a high voltage value. When the voltage value on the node N3 is pulled-down to be lower than the threshold value Vth, the comparison element CE2 inverts the voltage value on the node N3 to provide the second comparison signal SC_B on the node N4 having the high reference voltage VDD.

It should be noted, the voltage value of the second data signal SD_B is lower than the voltage value of the first data signal SD_A. The voltage values on the node N1 is lower than and the voltage values on the node N3 when the reset time interval TD1 is finished. Therefore, in the emission time interval TD2, a transition time point of the first comparison signal SC_A is earlier than a transition time point of the second comparison signal SC_B. The subtraction unit 222 generates the subtraction signal SS having the high voltage (e.g. the high reference voltage VDD) according to a difference between the transition time point of the first comparison signal SC_A and the transition time point of the second comparison signal SC_B.

It should be noted, for example, the TFT T3 includes a parasitic capacitance CP1. The TFT T6 includes a parasitic capacitance CP2. The parasitic capacitances CP1 and CP2 may cause a timing shift of the first comparison signal SC_A and the second comparison signal SC_B. The subtraction unit 222 generates the subtraction signal SS having the high voltage (e.g. the high reference voltage VDD) according to a difference between the transition time point of the first comparison signal SC_A and the transition time point of the second comparison signal SC_B. Therefore, the timing shift may be eliminated.

Figure 5:
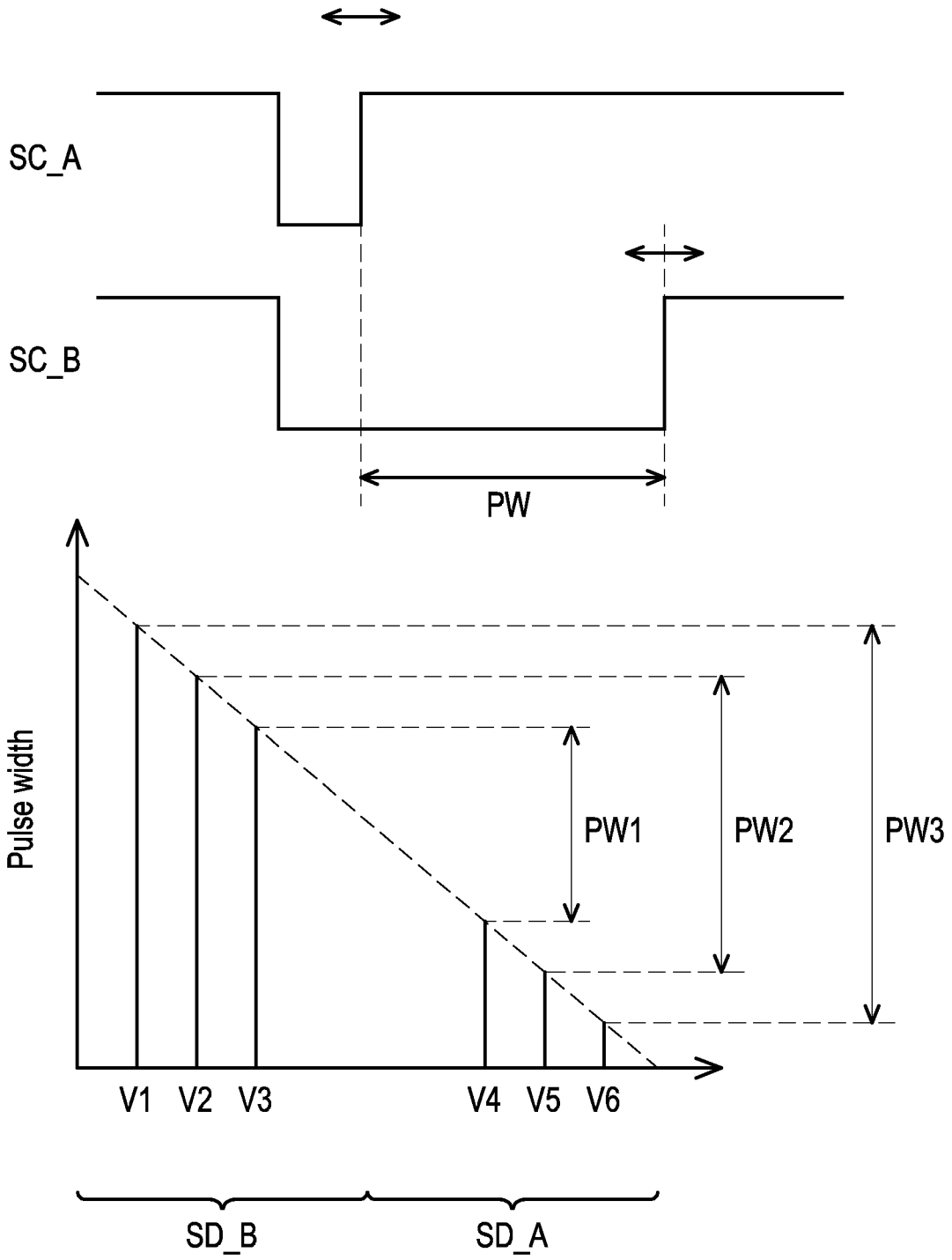
FIG. 5 illustrates a schematic diagram of a relationship between a pulse width of a subtraction signal, a first data signal and a second data signal of FIG. 3.

FIG. 5 illustrates a schematic diagram of a relationship between a pulse width of a subtraction signal, a first data signal and a second data signal according to a third embodiment of the disclosure. Referring to FIG. 5, if the sweeping signal SWP is used for swept-down. The voltage value of the second data signal SD_B is designed to be lower than the voltage value of the first data signal SD_A. A pulse width PW of the subtraction signal is determined based on a rising edge of the first comparison signal SC_A and a rising edge of the second comparison signal SC_B. Therefore, if the pulse width of the subtraction signal is increased from a pulse width PW2 to a pulse width PW3, the voltage value of the second data signal SD_B is increased from a voltage value V2 to a voltage value V1 and the voltage value of the first data signal SD_A is decreased from a voltage value V5 to a voltage value V6. If the pulse width of the subtraction signal is decreased from the pulse width PW2 to a pulse width PW1, the voltage value of the second data signal SD_B is decreased from the voltage value V2 to a voltage value V3 and the voltage value of the first data signal SD_A is increased from a voltage value V5 to a voltage value V4.

Figure 6:
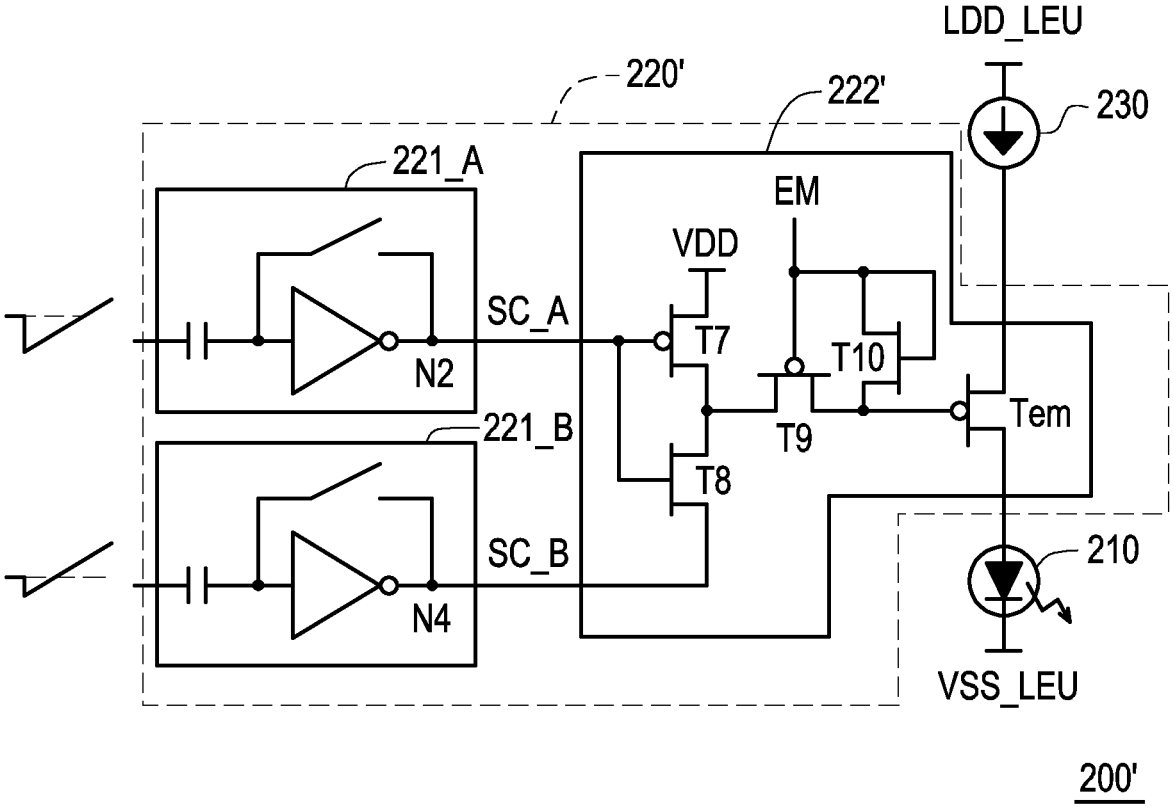
FIG. 6 illustrates a schematic diagram of an electronic device according to a third embodiment of the disclosure.

FIG. 6 illustrates a schematic diagram of an electronic device according to a third embodiment of the disclosure. In the embodiment, an electronic device 200' includes a semiconductor element 210, a pixel circuit 220' and a current source 230. The pixel circuit 220 includes comparators 221_A, 221_B and a subtraction unit 222'. The semiconductor element 210, the current source 230 and the comparators 221_A, 221_B can be inferred by referring to the relevant description of the FIG. 3, which is not repeated hereinafter. The subtraction unit 222' includes TFTs T7, T8, T9, T10 and the enable TFT Tem. A first terminal of the TFT T7 is coupled to a high reference voltage VDD. A control terminal of the TFT T7 receives the first comparison signal SC_A. A first terminal of the TFT T8 is coupled to a second terminal of the TFT T7. A second terminal of the TFT T8 receives the second comparison signal SC_B. A control terminal of the TFT T8 receives the first comparison signal SC_A. A first terminal of the TFT T9 is coupled to a second terminal of the TFT T7. A control terminal of the TFT T9 receives an emission enable signal EM. A first terminal of the fourth TFT T10 and a control terminal of the TFT T10 receive the emission enable signal EM. A second terminal of the TFT T10 is coupled to a second terminal of the TFT T9. A first terminal of the enable TFT Tem receives an emission current IE. A second terminal of the enable TFT Tem is coupled to the semiconductor element 210. A control terminal of the enable TFT Tem is coupled to the second terminal of the TFT T8 and receives the subtraction signal SS.

Figure 7:
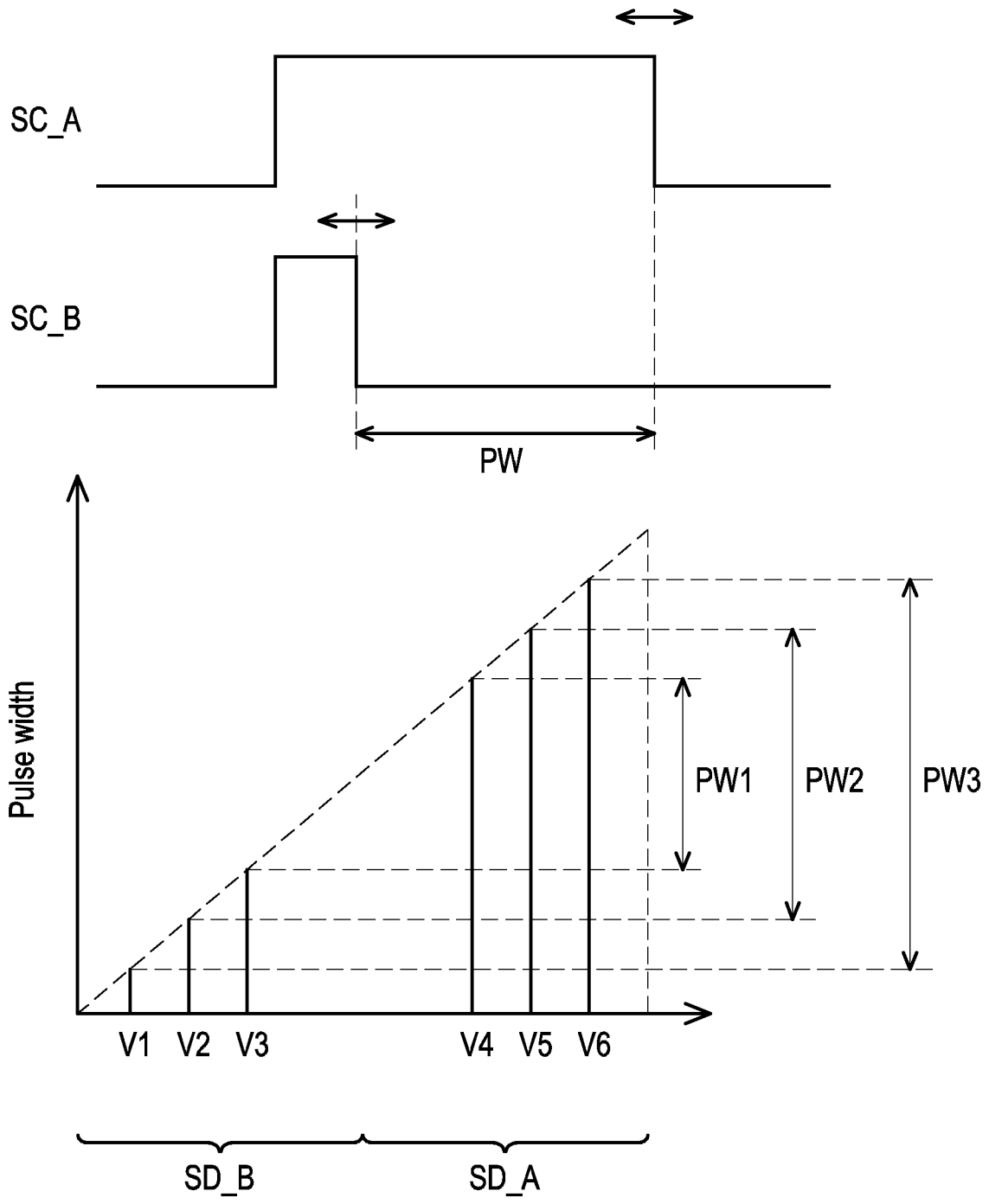
FIG. 7 illustrates another schematic diagram of a relationship between a pulse width of a subtraction signal, a first data signal and a second data signal of FIG. 6.

FIG. 7 illustrates another schematic diagram of a relationship between a pulse width of a subtraction signal, a first data signal and a second data of FIG. 6. Referring to FIG. 6 and FIG. 7, if the sweeping signal SWP is used for swept-up. The voltage value of the second data signal SD_B is designed to be lower than the voltage value of the first data signal SD_A. A pulse width PW of the subtraction signal is determined based on a falling edge of the first comparison signal SC_A and a falling edge of the second comparison signal SC_B. Therefore, if the pulse width of the subtraction signal is increased from a pulse width PW2 to a pulse width PW3, the voltage value of the second data signal SD_B is decreased from a voltage value V2 to a voltage value V1 and the voltage value of the first data signal SD_A is increased from a voltage value V5 to a voltage value V6. If the pulse width of the subtraction signal is decreased from the pulse width PW2 to a pulse width PW1, the voltage value of the second data signal SD_B is increased from the voltage value V2 to a voltage value V3 and the voltage value of the first data signal SD_A is decreased from a voltage value V5 to a voltage value V4.

Figure 8:
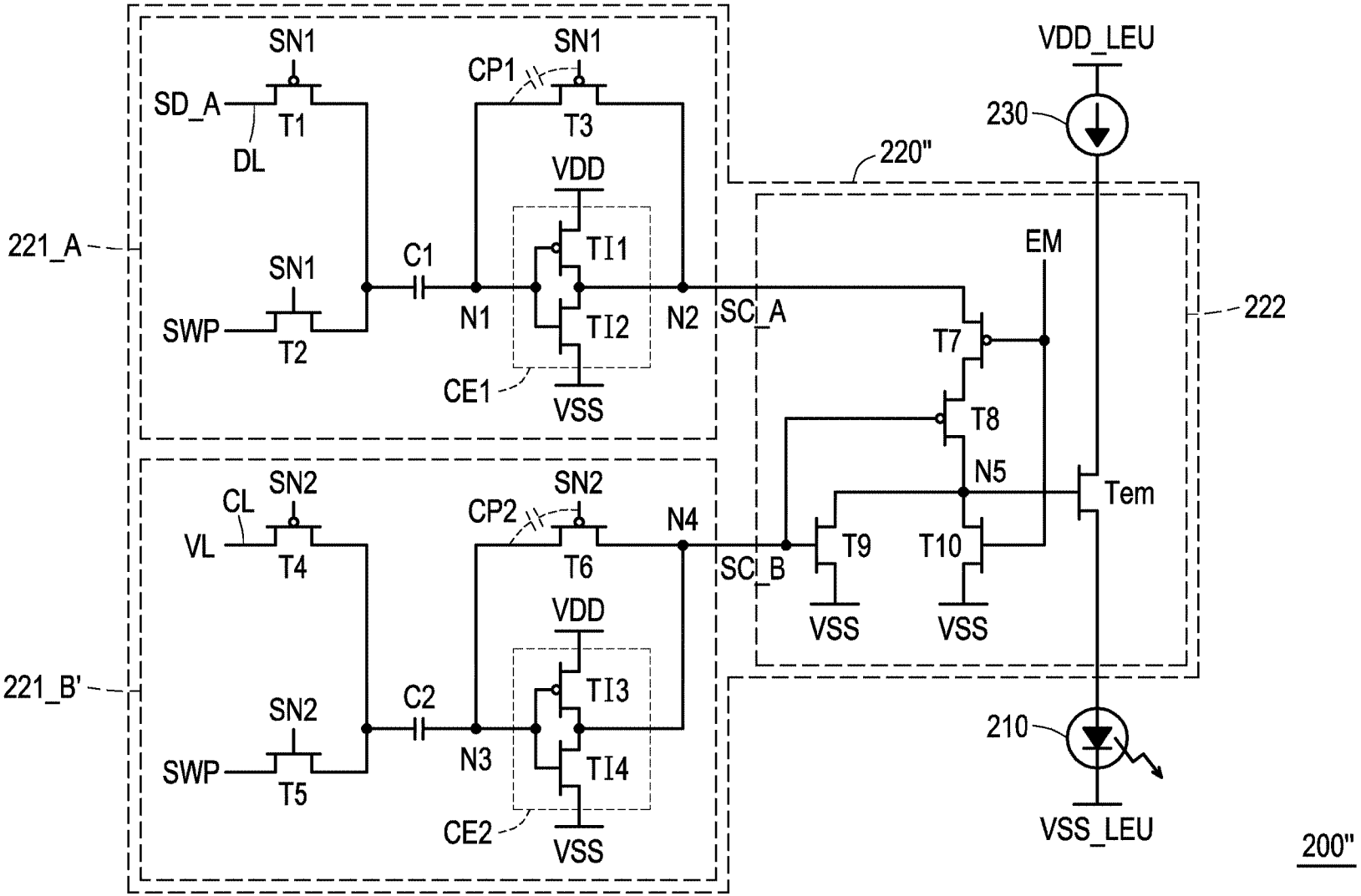
FIG. 8 illustrates a schematic diagram of an electronic device according to a fourth embodiment of the disclosure.
Figure 9:
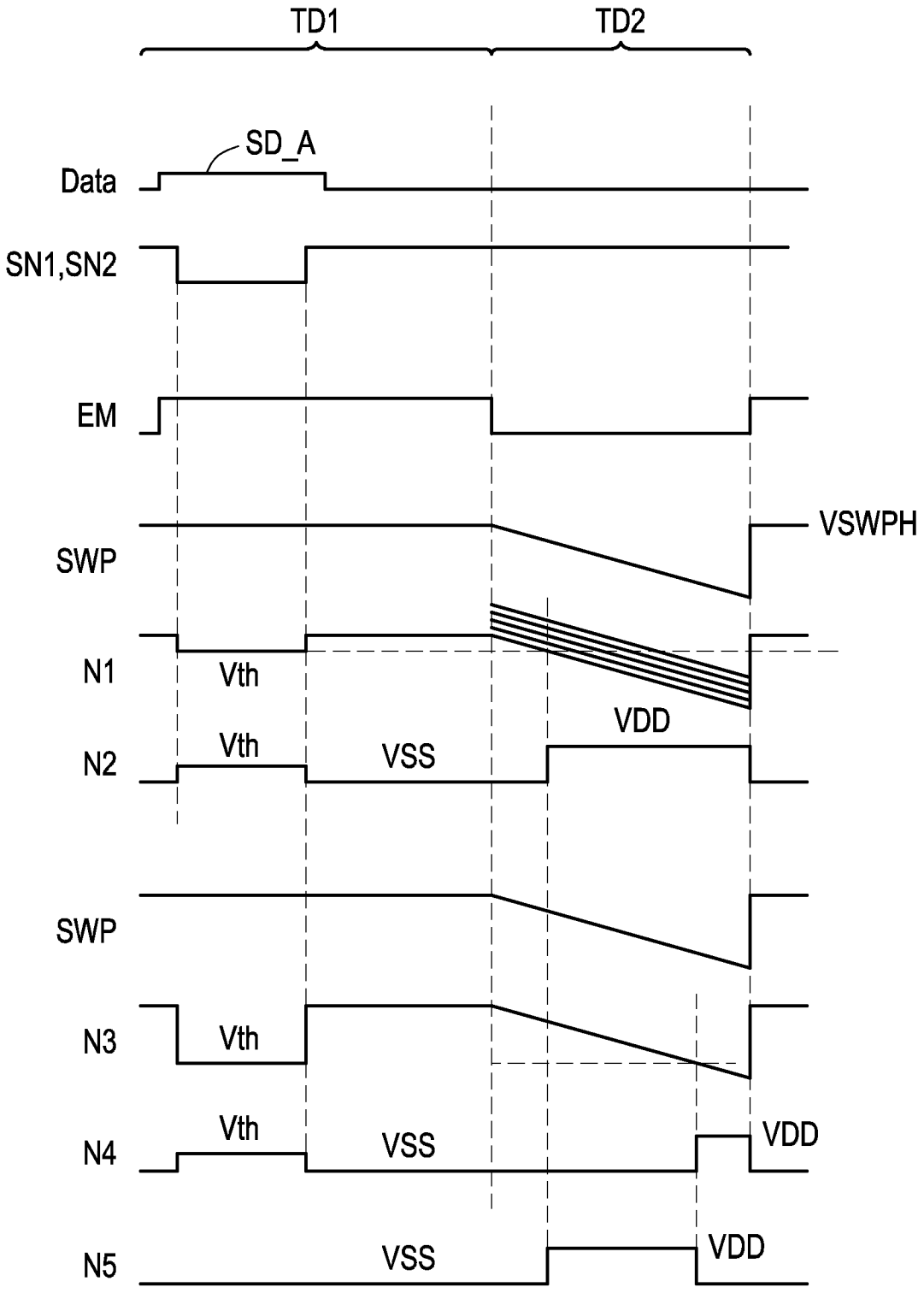
FIG. 9 illustrates an operating timing diagram of FIG. 8.

FIG. 8 illustrates a schematic diagram of an electronic device according to a fourth embodiment of the disclosure. FIG. 9 illustrates an operating timing diagram of FIG. 8. Referring to FIG. 8 and FIG. 9, in the embodiment, an electronic device 200" includes the semiconductor element 210, a pixel circuit 220" and the current source 230. The pixel circuit 220' includes the comparator 221_A, a comparator 221_B' and the subtraction unit 222. The semiconductor element 210, the current source 230, the comparator 221_A and the subtraction unit 222 can be inferred by referring to the relevant description of the FIG. 3, which is not repeated hereinafter.

In the embodiment, the comparator 221_B' includes TFTs T4, T5, T6, a capacitor C2 and a comparison element CE2. A first terminal of the TFT T4 is coupled to a common line CL and receives a reference signal VL via the common line CL. A control terminal of the TFT T4 receives the second control signal SN2. A first terminal of the TFT T5 receives the sweeping signal SWP. A control terminal of the TFT T5 receives the second control signal SN2. A first terminal of the capacitor C2 is coupled to a second terminal of the TFT T4 and a second terminal of the TFT T5. A first terminal (that is, a node N3) of the comparison element CE2 is coupled to a second terminal of the capacitor C2, and a second terminal (that is, a node N4) of the comparison element CE2 is coupled to the subtraction unit 222. A first terminal of the TFT T6 is coupled to the first terminal of the comparison element CE2. A second terminal of the TFT T6 is coupled to the second terminal of the comparison element CE2. A control terminal of the TFT T6 receives the second control signal SN2. In the embodiment, the TFTs T4 and T6 are the first type of TFTs respectively. The TFT T5 is the second type of TFT. For example, the TFTs T4 and T6 are PMOS respectively. The TFT T5 is NMOS. In the embodiment, the comparison element CE2 is an inverter.

In the embodiment, different from the embodiment of FIG. 3 and FIG. 4, the second control signal SN2 is the same as the first control signal SN1 substantially. Besides, the TFT T4 receives the reference signal VL. Therefore, in the reset time interval TD1, the voltage values on the nodes N1, N2, N3 and N4 are equal to threshold value Vth substantially when the first control signal SN1 and the second control signal SN2 have the first voltage value.

When the first control signal SN1 and the second control signal SN2 have the second voltage value, the comparator 221_A raises a voltage value on the node N1 from the threshold value Vth according to the difference between the voltage value of the first data signal SD_A and the maximum voltage value VSWPH of the sweeping signal SWP, and pulls-down the voltage value of the first comparison signal SC_A on the node N2 to a low voltage value. The comparator 221_B' raises a voltage value on the first terminal (that is, the node N3) of the comparison element CE2 from the threshold value Vth according to a difference between a voltage value of the reference signal VL and the maximum voltage value VSWPH of the sweeping signal SWP, and pulls-down the voltage value of the reference signal VL on the node N4 to the low voltage value. The reference signal VL may be the minimum voltage value of the second data signal SD_B. Therefore, in the emission time interval TD2, the comparator 221_B' provides the second comparison signal SC_B having a fixed timing.

In the embodiment, the first control signal SN1 and the second control signal SN2 can be one control signal. The second data signal SD_B is replaced with the reference signal VL. Therefore, a signal input manner of the pixel circuit 220" could be simplified.

Figure 10:
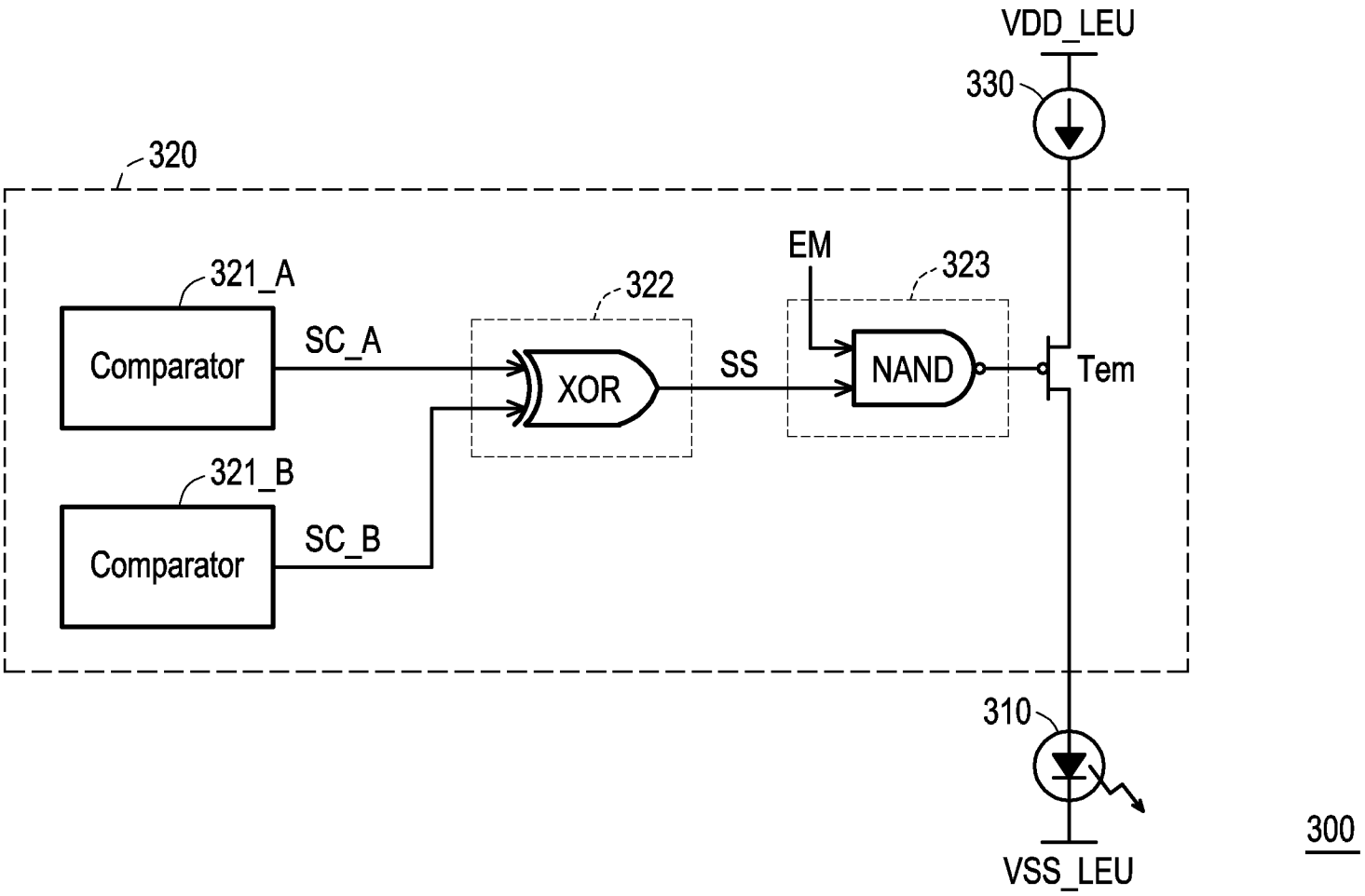
FIG. 10 illustrates a schematic diagram of an electronic device according to a fifth embodiment of the disclosure.

FIG. 10 illustrates a schematic diagram of an electronic device according to a fifth embodiment of the disclosure. Referring to FIG. 10, an electronic device 300 includes a semiconductor element 310, a pixel circuit 320 and a current source 330. The pixel circuit 320 includes comparators 321_A, 321_B, a subtraction unit 322, an emission control unit 323 and the enable TFT Tem. The semiconductor element 310, the comparator 321_A, the comparator 321_B, the enable TFT Tem and the current source 330 can be inferred by referring to the relevant description of the FIG. 1 and FIG. 3, which is not repeated hereinafter.

In the embodiment, the subtraction unit 322 includes a first logic gate. The first logic gate performs a first logic operation on the first comparison signal SC_A and the second comparison signal SC_B to generate the subtraction signal SS. For example, the first logic gate is a XOR gate. A first input terminal of the first logic gate is coupled to the comparator 321_A and receives the first comparison signal SC_A. A second input terminal of the first logic gate is coupled to the comparator 321_B and receives the second comparison signal SC_B. An output terminal of the first logic gate is coupled to the emission control unit 323. The first logic gate performs a XOR logic operation on the first comparison signal SC_A and the second comparison signal SC_B to generate the subtraction signal SS, and outputs the subtraction signal SS to the emission control unit 323.

In the embodiment, the emission control unit 323 includes a second logic gate. The second logic gate controls the enable TFT Tem according to the subtraction signal SS and the emission enable signal EM. For example, the enable TFT Tem is PMOS. Therefore, the second logic gate is a NAND gate. A first input terminal of the second logic gate receives the emission enable signal EM. A second input terminal of the second logic gate is coupled to the subtraction unit 322 and receives the subtraction signal SS. An output terminal of the second logic gate is coupled to the control terminal of enable TFT Tem. The second logic gate performs a NAND logic operation on the emission enable signal EM and the subtraction signal SS to generate a gate signal to controls the enable TFT Tem.

In some embodiments, the enable TFT Tem is NMOS. Therefore, the second logic gate is a AND gate. The second logic gate performs an AND logic operation on the emission enable signal EM and the subtraction signal SS to generate a gate signal to controls the enable TFT Tem.

Figure 11:
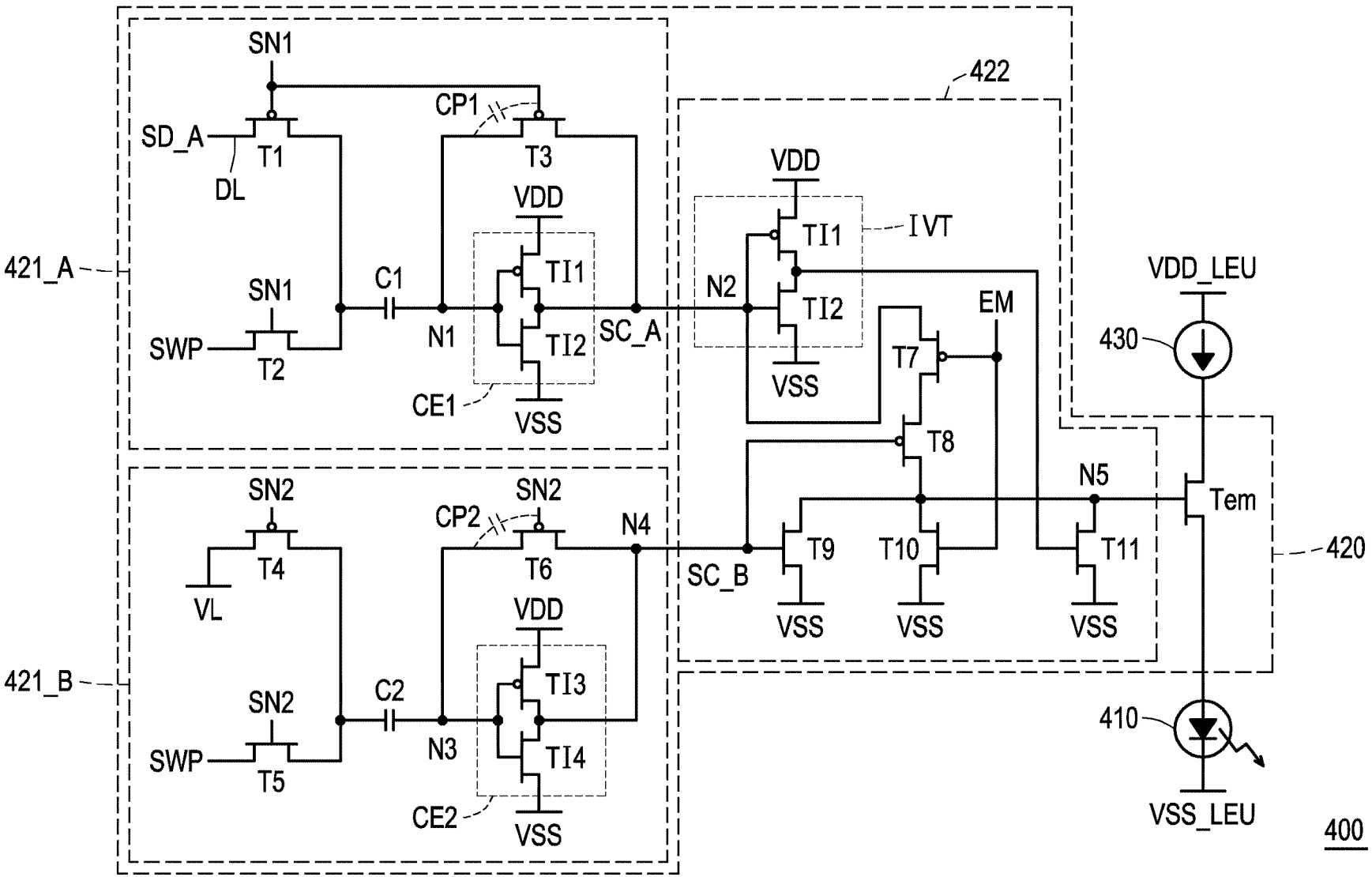
FIG. 11 illustrates a schematic diagram of an electronic device according to a sixth embodiment of the disclosure.

FIG. 11 illustrates a schematic diagram of an electronic device according to a sixth embodiment of the disclosure. Referring to FIG. 11, In the embodiment, an electronic device 400 includes a semiconductor element 410, a pixel circuit 420 and a current source 430. The pixel circuit 420 includes comparators 421_A, 421_B, a subtraction unit 422 and the enable TFT Tem. The semiconductor element 410, the comparator 421_A, the comparator 421_B, the enable TFT Tem and the current source 430 can be inferred by referring to the relevant description of the FIG. 1, FIG. 3, FIG. 8 and FIG. 10, which is not repeated hereinafter.

In the embodiment, the subtraction unit 422 includes TFTs T7, T8, T9, T10, T11 and an inverter IVT. A first terminal of the TFT T7 is coupled to the node N2 and receives the first comparison signal SC_A. A control terminal of the TFT T7 receives the emission enable signal EM. A first terminal of the TFT T8 is coupled to a second terminal of the TFT T7. A second terminal of the TFT T8 is an output terminal (that is node N5) of the subtraction unit 422. A control terminal of the TFT T8 is coupled to the node N4 and receives the second comparison signal SC_B. A first terminal of the TFT T9 is coupled to the output terminal and a second terminal of the TFT T8. A second terminal of the TFT T9 is coupled to the low reference voltage VSS. A control terminal of the TFT T9 receives the second comparison signal SC_B. A first terminal of the TFT T10 is coupled to the output terminal and the second terminal of the TFT T8. A second terminal of the TFT T10 is coupled to the low reference voltage VSS. A control terminal of the TFT T10 receives the emission enable signal EM. An input terminal of the inverter IVT is coupled to the node N2 and receives the first comparison signal SC_A. A first terminal of the TFT T11 is coupled to the output terminal and the second terminal of the TFT T8. A second terminal of the TFT T11 is coupled to the low reference voltage VSS. A control terminal of the TFT T11 is coupled to an output terminal of the inverter IVT and receives an inversion of the first comparison signal SC_A. In the embodiment, the TFTs T7 and T8 are the first type of TFTs respectively. The TFTs T9, T10, T11 and the enable TFT Tem are the second type of TFTs respectively. For example, the TFTs T7 and T8 are PMOS respectively. The TFTs T9, T10, T11 and the enable TFT Tem are NMOS. The subtraction unit 422 is an alternative of the logic operations of the fourth embodiment in FIG. 10.

In some embodiments, the enable TFT Tem may be integrated in the subtraction unit 422.

Figure 12:
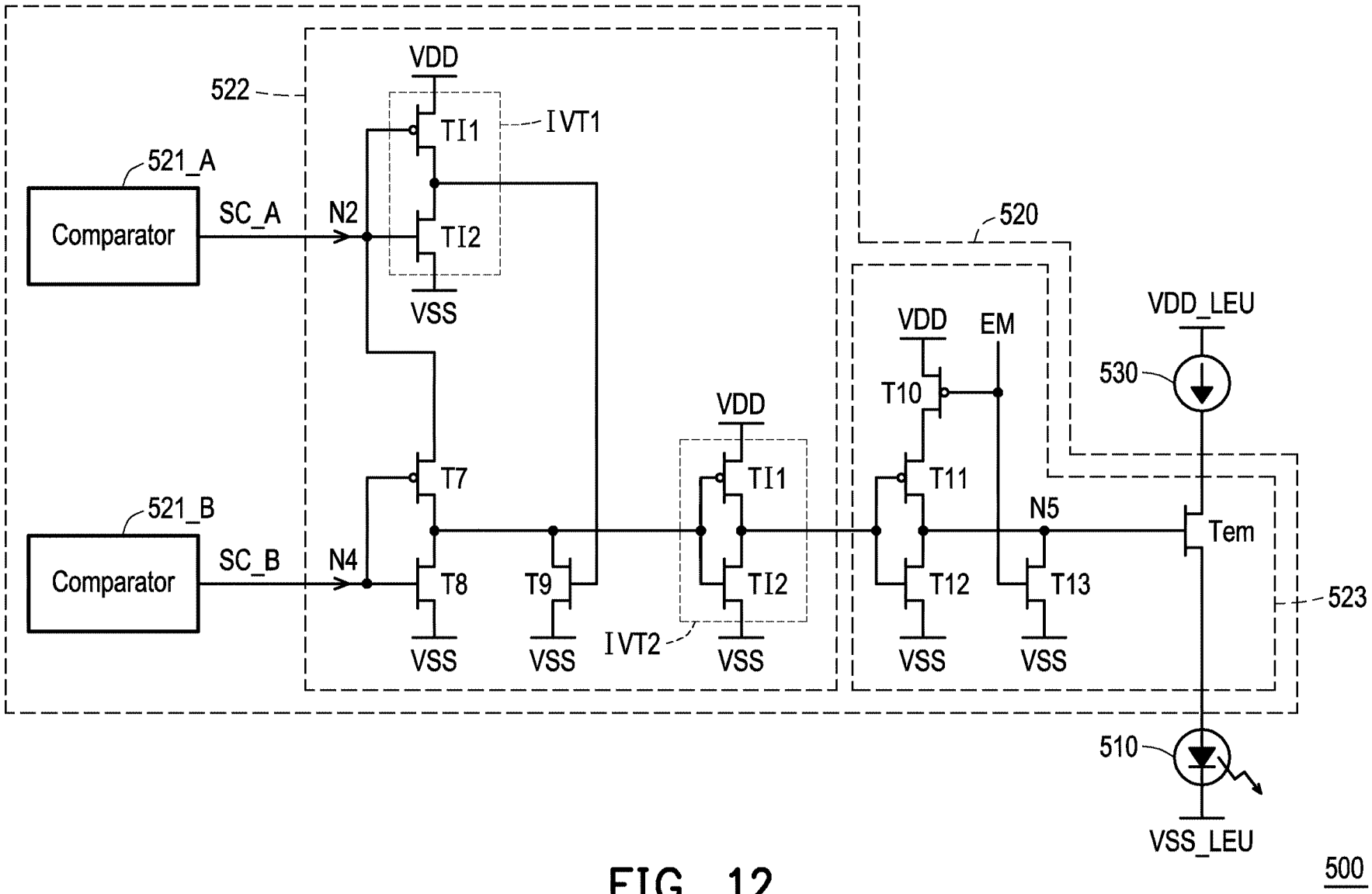
FIG. 12 illustrates a schematic diagram of an electronic device according to a seventh embodiment of the disclosure.

FIG. 12 illustrates a schematic diagram of an electronic device according to a seventh embodiment of the disclosure. Referring to FIG. 12, In the embodiment, an electronic device 500 includes a semiconductor element 510, a pixel circuit 520 and a current source 530. The pixel circuit 520 includes comparators 521_A, 521_B, a subtraction unit 522 and an emission control unit 523. The semiconductor element 510, the comparator 521_A, the comparator 521_B and the current source 530 can be inferred by referring to the relevant description of the FIG. 1, FIG. 3, FIG. 8 and FIG. 10, which is not repeated hereinafter.

In the embodiment, the subtraction unit 522 includes TFTs T7, T8, T9, and an inverter IVT1, IVT2. A first terminal of the TFT T7 is coupled to the node N2 and receives the first comparison signal SC_A. A control terminal of the TFT T7 is coupled to the node N4 and receives the second comparison signal SC_B. A first terminal of the TFT T8 is coupled to a second terminal of the TFT T7. A second terminal of the TFT T8 is coupled to the low reference voltage VSS. A control terminal of the TFT T8 receives the second comparison signal SC_B. An input terminal of the inverter IVT1 is coupled to the node N2 and receives the first comparison signal SC_A. A first terminal of the TFT T9 is coupled to the second terminal of the TFT T7. A second terminal of the TFT T9 is coupled to the low reference voltage VSS. A control terminal of the TFT T9 is coupled to an output terminal of the inverter IVT1 and receives an inversion of the first comparison signal SC_A. An input terminal of the inverter IVT2 is coupled to the second terminal of the TFT T7. An output terminal of the inverter IVT2 is coupled to the emission control unit 523. In the embodiment, the TFT T7 is the first type of TFT. The TFTs T8, T9 are the second type of TFTs respectively. For example, the TFT T7 are PMOS respectively. The TFTs T8, T9 are NMOS respectively.

In the embodiment, the emission control unit 523 includes TFTs T10, T11, T12, T13 and the enable TFT Tem. A first terminal of the enable TFT Tem receives an emission current from the current source 530. A second terminal of the enable TFT Tem is coupled to the semiconductor element 510. A control terminal of the enable TFT Tem receives the subtraction signal from a node N5. A first terminal of the TFT T10 is coupled to the high reference voltage VDD. A control terminal of the TFT T10 receives the emission enable signal EM. A first terminal of the TFT T11 is coupled to a second terminal of the TFT T10. A second terminal of the TFT T11 is coupled to the node N5 and the control terminal of the enable TFT Tem. A control terminal of the TFT T11 is coupled to the output terminal of the inverter IVT2. A first terminal of the TFT T12 is coupled to the node N5 and the control terminal of the enable TFT Tem. A second terminal of the TFT T12 is coupled to the low reference voltage VSS. A control terminal of the TFT T12 is coupled to the output terminal of the inverter IVT2. A first terminal of the TFT T13 is coupled to the node N5 and the control terminal of the enable TFT Tem. A second terminal of the TFT T13 is coupled to the low reference voltage VSS. A control terminal of the TFT T13 is coupled to the emission enable signal EM. In the embodiment, the TFTs T10, T11 are the first type of TFT respectively. The TFTs T12, T13 and the enable TFT Tem are the second type of TFTs respectively. For example, the TFTs T10, T11 are PMOS respectively. The TFTs T12, T13 and the enable TFT Tem are NMOS respectively.

Figure 13:
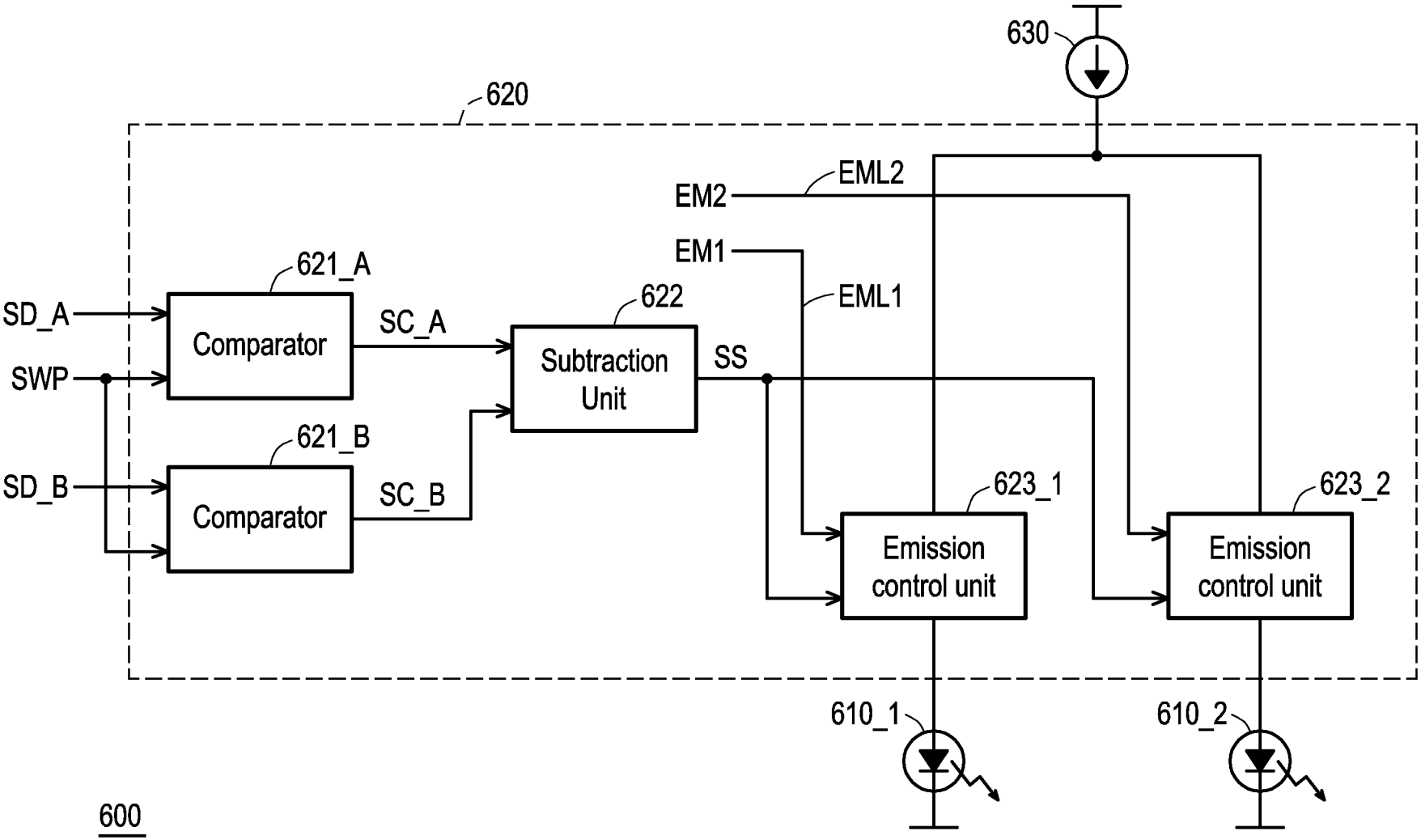
FIG. 13 illustrates a schematic diagram of a subtraction unit according to a eighth embodiment of the disclosure.

FIG. 13 illustrates a schematic diagram of a subtraction unit according to a eighth embodiment of the disclosure. Referring to FIG. 13, in the embodiment, an electronic device 600 includes semiconductor elements 610_1, 6102, a pixel circuit 620, a current source 630 and emission enable lines EML1, EML2. The pixel circuit 620 includes comparators 621_A, 621_B, a subtraction unit 622 and emission control units 623_1, 623_2. The comparators 621_A, 621_B and the current source 630 can be inferred by referring to the relevant description of the FIG. 1, FIG. 3, FIG. 8 and FIG. 12, which is not repeated hereinafter. In the embodiment, the subtraction unit 622 may be implemented by the subtraction unit 522 in FIG. 12. Each of emission control units 623_1, 6232 may be implemented by the emission control unit 523 in FIG. 12.

The subtraction unit 622 is coupled to the emission control units 623_1, 623_2. The subtraction unit 622 provides the subtraction signal SS to the emission control units 623_1, 623_2. The emission control units 623_1 is coupled to the semiconductor elements 610_1 and is operated to provide an emission current from the current source 630 to the semiconductor elements 610_1 in a first operation control period. The emission control units 6232 is coupled to the semiconductor elements 610_2 and is operated to provide an emission current from the current source 630 to the semiconductor elements 610_2 in a second operation control period.

The emission enable line EML1 provide a first emission enable signal EM1 for operating in the first operation control period. For example, the emission enable line EML1 is coupled to the emission control unit 623_1. The emission enable line EML1 transmits the first emission enable signal EM1 to the emission control unit 623_1 in the first operation control period. Therefore, in the first operation control period, an operation period of the semiconductor element 610_1 is determined by the subtraction signal SS.

The emission enable line EML2 provide a second emission enable signal EM2 for operating in the second operation control period. For example, the emission enable line EML2 is coupled to the emission control unit 623_2. The emission enable line EML2 transmits the second emission enable signal EM2 to the emission control units 623_2 in the second operation control period. Therefore, in the second operation control period, an operation period of the semiconductor element 610_2 is determined by the subtraction signal SS. In other words, the semiconductor elements 610_1, 610_2 are operated by the same subtraction signal SS in different operation control period. In other words, the operation control periods of the plurality of semiconductor elements 6101, 610_2 are specified by the corresponding subtraction signal SS and the emission enable signals EM1, EM2.

Figure 14:
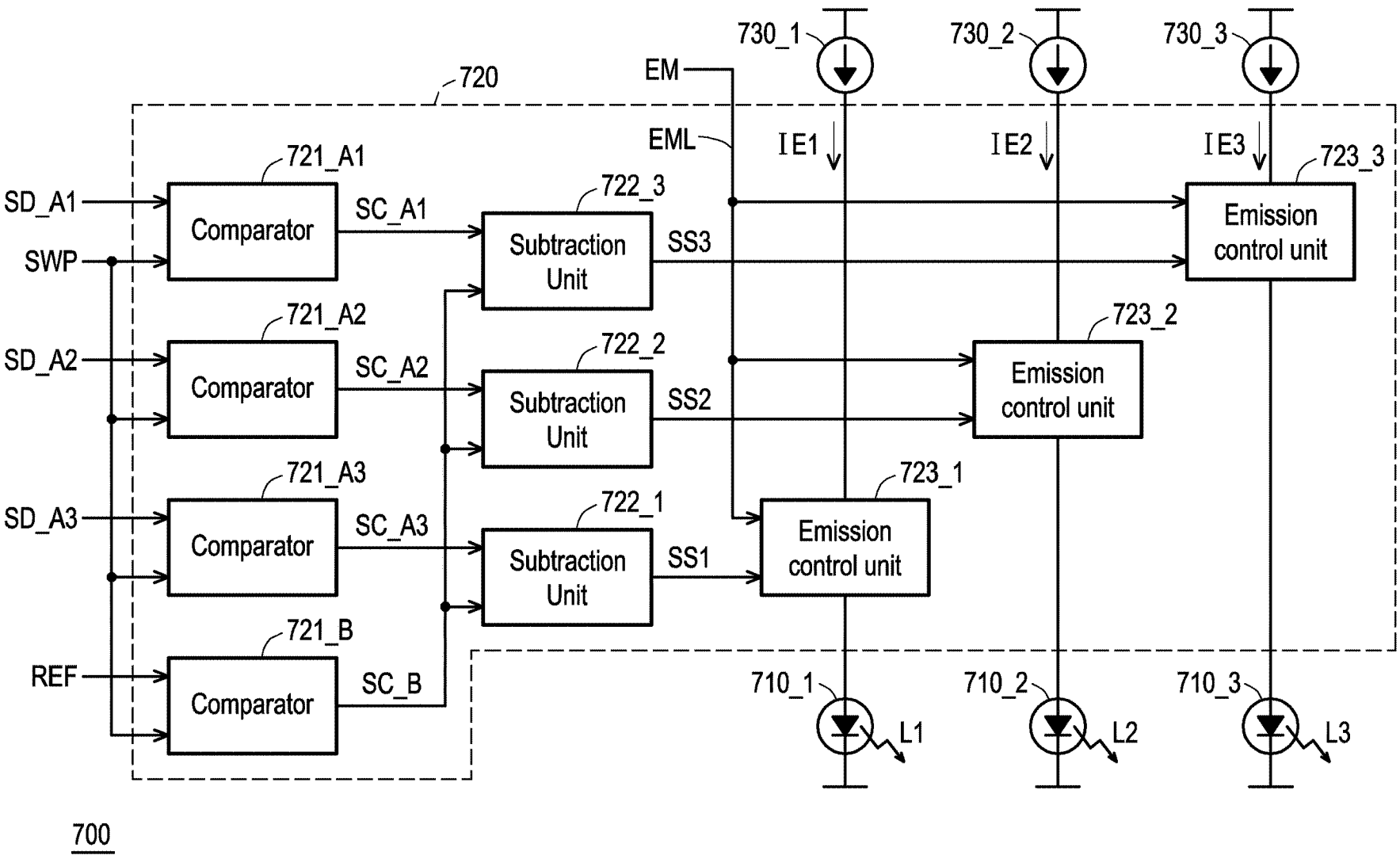
FIG. 14 illustrates a schematic diagram of a subtraction unit according to an ninth embodiment of the disclosure.

FIG. 14 illustrates a schematic diagram of a subtraction unit according to an ninth embodiment of the disclosure. Referring to FIG. 14, In the embodiment, an electronic device 700 includes semiconductor elements 710_1, 710_2, 710_3, a pixel circuit 720, a current source 730_1, 7302, 730_3 and an emission enable line EML. The pixel circuit 720 includes comparators 721_B, 721_A1, 721_A2, 721_A3, subtraction units 722_1, 7222, 722_3 and emission control units 723_1, 7232, 723_3. The comparator 721_B generates the first comparison signal SC_B according to the first data signal REF and the sweeping signal SWP. The first data signal REF is a reference signal. The comparators 721_A1 generates the second comparison signal SC_A1 according to the second data signal SD_A1 and the sweeping signal SWP. The comparators 721_A2 generates the second comparison signal SC_A2 according to the second data signal SD_A2 and the sweeping signal SWP. The comparators 721_A3 generates the second comparison signal SC_A3 according to the second data signal SD_A3 and the sweeping signal SWP.

The subtraction units 722_1 is coupled to comparators 721_B, 721_A3 and the emission control unit 723_1. The subtraction units 7221 generates a subtraction signal SS1 according to the first comparison signal SC_B and the second comparison signal SC_A3, and provides subtraction signal SS1 to the emission control unit 723_1. The subtraction units 722_2 is coupled to comparators 721_B, 721_A2 and the emission control unit 723_2. The subtraction units 722_2 generates a subtraction signal SS2 according to the first comparison signal SC_B and the second comparison signal SC_A2, and provides subtraction signal SS2 to the emission control unit 723_2. The subtraction units 722_3 is coupled to comparators 721_B, 721_A1 and the emission control unit 723_3. The subtraction units 722_3 generates a subtraction signal SS3 according to the first comparison signal SC_B and the second comparison signal SC_A1, and provides subtraction signal SS3 to the emission control unit 723_3. In the embodiment, the subtraction signals SS1, SS2, SS3 are generated based on the same first comparison signal SC_B from the comparator 721_B. Therefore, the circuit area of the pixel circuit 720 could be decreased.

The emission enable line EML is coupled to the semiconductor elements 710_1, 710_2, 710_3. In the embodiment, the emission enable line EML is coupled to the emission control units 7231, 7232, 723_3. The emission enable line EML transmits the emission enable signal EM to the emission control units 723_1, 7232, 723_3. The emission control unit 723_1 provides the emission current IE1 from the current source 730_1 to the semiconductor element 710_1 in response to the subtraction signal SS1 and the emission enable signal EM. The emission control unit 7232 provides the emission current IE2 from the current source 730_2 to the semiconductor element 710_2 in response to the subtraction signal SS2 and the emission enable signal EM. The emission control unit 723_3 provides the emission current IE3 from the current source 730_3 to the semiconductor element 710_3 in response to the subtraction signal SS3 and the emission enable signal EM. Therefore, the semiconductor elements 710_1, 710_2, 710_3 emit light based on the different subtraction signal in the same operation control period. In the embodiment, each of the emission control units 723_1, 7232, 723_3 may be implemented by the emission control unit 523 in FIG. 12.

In the embodiment, the semiconductor element 710_1 emits a light L1. The semiconductor element 710_2 emits a light L2. The semiconductor element 710_3 emits a light L3. For example, the semiconductor element 710_1 emits the light L1 having a first color light. The semiconductor element 710_2 emits the light L2 having a second color light. The semiconductor element 710_3 emits the light L3 having a third color light. For example, the semiconductor element 710_1 emits blue light. The semiconductor element 710_2 emits the light L2 having a green light. The semiconductor element 710_3 emits the light L3 having red light.

In summary, in the embodiments of the disclosure, the subtraction unit generates the subtraction signal according to the first comparison signal from first the comparator and the second comparison signal from the second comparator. The voltage errors from the comparator and the comparator may be eliminated. Therefore, the voltage error from a transistor in the electronic device 100 may be reduced.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An electronic device, comprising:

at least one semiconductor element; and a pixel circuit, coupled to the at least one semiconductor element, comprising:

a first comparator, configured to generate a first comparison signal;

a second comparator, configured to generate a second comparison signal; and at least one subtraction unit, coupled to the at least one semiconductor element and configured to receive the first comparison signal and the second comparison signal, and generate a subtraction signal.

2. The electronic device of claim 1, wherein one of the at least one semiconductor element comprises at least one LED.

3. The electronic device of claim 1, wherein the first comparator comprises:

a first thin-film transistor (TFT), wherein a first terminal of the first TFT is coupled to a first data line and configured to receive a first data signal;

a second TFT, wherein a first terminal of the second TFT is configured to receive a sweeping signal;

a first capacitor, wherein a first terminal of the first capacitor is coupled to a second terminal of the first TFT and a second terminal of the second TFT;

a first comparison element, wherein a first terminal of the first comparison element is coupled to a second terminal of the first capacitor, and a second terminal of the first comparison element is coupled to the at least one subtraction unit; and a third TFT, wherein a first terminal of the third TFT is coupled to the first terminal of the first comparison element, and a second terminal of the third TFT is coupled to the second terminal of the first comparison element.

4. The electronic device of claim 3, wherein:

a control terminal of the first TFT is configured to receive a first control signal, a control terminal of the second TFT is configured to receive the first control signal, and a control terminal of the third TFT is configured to receive the first control signal.

5. The electronic device of claim 3, wherein the first TFT and the third TFT are PMOS type, respectively, and the second TFT is NMOS type.

6. The electronic device of claim 3, wherein the first comparison element is an inverter.

7. The electronic device of claim 3, wherein the second comparator comprises:

a fourth TFT;

a fifth TFT, wherein a first terminal of the fifth TFT is configured to receive the sweeping signal;

a second capacitor, wherein a first terminal of the second capacitor is coupled to a second terminal of the fourth TFT and a second terminal of the fifth TFT;

a second comparison element, wherein a first terminal of the second comparison element is coupled to a second terminal of the second capacitor, and a second terminal of the second comparison element is coupled to the at least one subtraction unit; and a sixth TFT, wherein a first terminal of the sixth TFT is coupled to the first terminal of the second comparison element, a second terminal of the sixth TFT is coupled to the second terminal of the second comparison element.

8. The electronic device of claim 7, wherein a first terminal of the fourth TFT is coupled to a second data line and configured to receive a second data signal.

9. The electronic device of claim 7, wherein a first terminal of the fourth TFT is coupled to a common line and configured to receive a reference signal.

10. The electronic device of claim 7, wherein:

a control terminal of the fourth TFT is configured to receive a second control signal, a control terminal of the fifth TFT is configured to receive the second control signal, and a control terminal of the sixth TFT is configured to receive the second control signal.

11. The electronic device of claim 7, wherein the second comparison element is an inverter.

12. The electronic device of claim 7, wherein the fourth TFT and the sixth TFT are PMOS type, respectively, and the fifth TFT is NMOS type.

13. The electronic device of claim 1, wherein the pixel circuit further comprises:

an emission control unit, coupled to the at least one subtraction unit and the at least one semiconductor element, and configured to transmit an emission current to the at least one semiconductor element in response to the subtraction signal and an emission enable signal.

14. The electronic device of claim 1, wherein one of the at least one subtraction unit comprises:

a first thin-film transistor (TFT), wherein a first terminal of the first TFT is configured to receive the first comparison signal, and a control terminal of the first TFT is configured to receive an emission enable signal;

a second TFT, wherein a first terminal of the second TFT is coupled to a second terminal of the first TFT, and a control terminal of the second TFT is configured to receive the second comparison signal;

a third TFT, wherein a first terminal of the third TFT is coupled to a second terminal of the second TFT, a second terminal of the third TFT is coupled to a low reference voltage, and a control terminal of the third TFT is configured to receive the second comparison signal;

a fourth TFT, wherein a first terminal of the fourth TFT is coupled to the second terminal of the second TFT, a second terminal of the fourth TFT is coupled to the low reference voltage, and a control terminal of the fourth TFT is configured to receive the emission enable signal; and an enable TFT, wherein a first terminal of the enable TFT is configured to receive an emission current, a second terminal of the enable TFT is coupled to the at least one semiconductor element, and a control terminal of the enable TFT is coupled to the second terminal of the second TFT and configured to receive the subtraction signal.

15. The electronic device of claim 1, wherein one of the at least one subtraction unit comprises:

a first thin-film transistor (TFT), wherein a first terminal of the first TFT is coupled to a high reference voltage, and a control terminal of the first TFT is configured to receive the first comparison signal;

a second TFT, wherein a first terminal of the second TFT is coupled to a second terminal of the first TFT, a second terminal of the second TFT is configured to receive the second comparison signal, and a control terminal of the second TFT is configured to receive the first comparison signal;

a third TFT, wherein a first terminal of the third TFT is coupled to a second terminal of the first TFT, and a control terminal of the third TFT is configured to receive an emission enable signal;

a fourth TFT, wherein a first terminal of the fourth TFT and a control terminal of the fourth TFT are configured to receive the emission enable signal, a second terminal of the fourth TFT is coupled to a second terminal of the third TFT; and an enable TFT, wherein a first terminal of the enable TFT is configured to receive an emission current, a second terminal of the enable TFT is coupled to the at least one semiconductor element, and a control terminal of the enable TFT is coupled to the second terminal of the third TFT and is configured to receive the subtraction signal.

16. The electronic device of claim 1, wherein the at least one semiconductor element comprises a plurality of semiconductor elements, wherein the pixel circuit further comprises:

a plurality of emission control units, coupled to the at least one subtraction unit and a corresponding semiconductor element of the plurality of semiconductor elements, respectively, wherein the plurality of emission control units are configured to receive the subtraction signal and different emission enable signals, wherein operation control periods of the plurality of semiconductor elements are each specified by a corresponding emission enable signal and the subtraction signal.

17. The electronic device of claim 1, wherein the at least one semiconductor element comprises a plurality of semiconductor elements, wherein the at least one subtraction unit comprises a plurality of subtraction units, wherein the pixel circuit further comprises:

a plurality of emission control units, coupled to a corresponding subtraction unit of the plurality of subtraction units and a corresponding semiconductor element of the plurality of semiconductor elements, respectively, wherein the plurality of emission control units are configured to receive a corresponding subtraction signal and an emission enable signal, wherein operation control periods of the plurality of semiconductor elements are each specified by the corresponding subtraction signal and the emission enable signal.

18. The electronic device of claim 1, wherein one of the at least one subtraction unit comprises:

a first thin-film transistor (TFT), wherein a first terminal of the first TFT is configured to receive the first comparison signal, and a control terminal of the first TFT is configured to receive an emission enable signal, a second TFT, wherein a first terminal of the second TFT is coupled to a second terminal of the first TFT, and a control terminal of the second TFT is configured to receive the second comparison signal, a third TFT, wherein a first terminal of the third TFT is coupled to a second terminal of the second TFT, a second terminal of the third TFT is coupled to a low reference voltage, and a control terminal of the third TFT is configured to receive the second comparison signal, a fourth TFT, wherein a first terminal of the fourth TFT is coupled to the second terminal of the second TFT, second terminal of the fourth TFT is coupled to the low reference voltage, and a control terminal of the fourth TFT is configured to receive the emission enable signal, an inverter, wherein an input terminal of the inverter is configured to receive the first comparison signal, a fifth TFT, wherein a first terminal of the fifth TFT is coupled to the second terminal of the second TFT, a second terminal of the fifth TFT is coupled to the low reference voltage, and a control terminal of the fifth TFT is coupled to an output terminal of the inverter.

19. The electronic device of claim 1, wherein one of the at least one subtraction unit comprises:

a first thin-film transistor (TFT), wherein a first terminal of the first TFT is configured to receive the first comparison signal, and a control terminal of the first TFT is configured to receive the second comparison signal, a second TFT, wherein a first terminal of the second TFT is coupled to a second terminal of the first TFT, a second terminal of the second TFT is coupled to a low reference voltage, and a control terminal of the second TFT is configured to receive the second comparison signal, a first inverter, wherein an input terminal of the first inverter is configured to receive the first comparison signal, a third TFT, wherein a first terminal of the third TFT is coupled to the second terminal of the first TFT, a second terminal of the third TFT is coupled to the low reference voltage, and a control terminal of the third TFT is coupled to an output terminal of the first inverter, a second inverter, wherein an input terminal of the second inverter is coupled to the second terminal of the first TFT, and an output terminal of the second inverter is coupled to an emission control unit.

20. The electronic device of claim 19, wherein the emission control unit comprises:

an enable TFT, wherein a first terminal of the enable TFT is configured to receive an emission current and a second terminal of the enable TFT is coupled to the at least one semiconductor element;

a fourth TFT, wherein a first terminal of the fourth TFT is coupled to a high reference voltage, and a control terminal of the fourth TFT is configured to receive the emission enable signal;

a fifth TFT, wherein a first terminal of the fifth TFT is coupled to the second terminal of the fourth TFT, a second terminal of the fifth TFT is coupled to a control terminal of the enable TFT, and a control terminal of the fifth TFT is coupled to the output terminal of the second inverter;

a sixth TFT, wherein a first terminal of the sixth TFT is coupled to the second terminal of the fifth TFT, a second terminal of the sixth TFT is coupled to the low reference voltage, and a control terminal of the sixth TFT is coupled to the output terminal of the second inverter; and a seventh TFT, wherein a first terminal of the seventh TFT is coupled to the second terminal of the fifth TFT, a second terminal of the seventh TFT is coupled to the low reference voltage, and a control terminal of the seventh TFT is configured to receive the emission enable signal.

* * * * *